US006139292A

United States Patent [19]

Kimura

[11] Patent Number: 6,139,292

[45] Date of Patent: Oct. 31, 2000

[54] SCROLL-TYPE FLUID DISPLACEMENT APPARATUS INCLUDING OLDHAM COUPLING MECHANISM AND METHOD FOR MANUFACTURING SUCH APPARATUS

[75] Inventor: Yoshio Kimura, Maebashi, Japan

[73] Assignee: Sanden Corporation, Gunma, Japan

[21] Appl. No.: 09/110,250

[22] Filed: Jul. 6, 1998

[30] Foreign Application Priority Data

Jul. 4, 1997 [JP] Japan ..... 9-179611

[51] Int. Cl.[7] ..... F04C 18/00

[52] U.S. Cl. ..... 418/55.3; 418/55.1; 418/179; 418/152; 418/55.2

[58] Field of Search ..... 418/55.1, 179, 418/152, 55.3, 55.2

[56] References Cited

U.S. PATENT DOCUMENTS

| | | | |
|---|---|---|---|
| 4,325,683 | 4/1982 | Miyazawa . | |
| 4,340,339 | 7/1982 | Higara et al. | 418/55 |
| 4,655,696 | 4/1987 | Utter . | |
| 4,874,302 | 10/1989 | Kobayashi et al. . | |
| 4,992,033 | 2/1991 | Caillat et al. . | |
| 5,071,329 | 12/1991 | Sano et al. . | |
| 5,275,543 | 1/1994 | Tanaka et al. . | |
| 5,295,812 | 3/1994 | Steele | 418/55.1 |
| 5,584,678 | 12/1996 | Hirooka et al. | 418/55.2 |
| 5,643,781 | 7/1997 | Yoshida et al. . | |
| 5,704,773 | 1/1998 | Higashiyama | 418/55.3 |

FOREIGN PATENT DOCUMENTS

| | | | |
|---|---|---|---|
| 38152 | 10/1981 | European Pat. Off. | 418/55.3 |
| 0475545 | 7/1991 | European Pat. Off. . | |
| 0475545 | 3/1992 | European Pat. Off. | 418/55.3 |
| 0855509 | 1/1998 | European Pat. Off. . | |
| 62-169375 | 6/1987 | Japan . | |
| 63-088288 | 4/1988 | Japan . | |
| 63-138181 | 6/1988 | Japan . | |
| 63-170578 | 7/1988 | Japan . | |

*Primary Examiner*—Thomas Denion
*Assistant Examiner*—Thai-Ba Trieu
*Attorney, Agent, or Firm*—Baker Botts L.L.P.

[57] ABSTRACT

A scroll-type fluid displacement apparatus comprises a housing having an inlet port and outlet port and is made of non-ferrous metal. The housing has a first casing and second casing that is connected to the first casing. A fixed scroll is fixedly disposed within the housing and has a first circular end plate from which a first spiral element entered into the housing. An orbiting scroll has a pair of parallel first grooves formed on a second circular end plate. A second spiral element extends from the second circular end plate such that the first spiral element interfits the second spiral element at an angular and radial offset to make a plurality of line contacts to define a pair of fluid pockets within the housing. A driving mechanism is connected to the orbiting scroll to effect orbital motion of the orbiting scroll. An Oldham ring is coupled to the orbiting scroll for preventing rotation of the orbiting scroll during orbital motion. The Oldham ring has a pair of first key portions and a pair of second key portions. The second key portions are perpendicular to the pair of first key portions. The first key portions engage the parallel first grooves on the second circular end plate. A supporting plate member is disposed between the housing and the orbiting scroll to support the thrust load of the orbiting scroll. The supporting plate member, which is made of ferrous metal, has a pair of grooves formed on one end surface for engaging the second key portions of the Oldham ring.

6 Claims, 5 Drawing Sheets

SCROLL-TYPE FLUID DISPLACEMENT APPARATUS INCLUDING OLDHAM COUPLING MECHANISM AND METHOD FOR MANUFACTURING SUCH APPARATUS

BACKGROUND OF THE INVENTION

1. Field of the Invention

The invention relates to a scroll-type fluid displacement apparatus. More particularly, it relates to an Oldham coupling mechanism for a scroll-type refrigerant compressor, such as that used in an automotive air conditioning system.

2. Description of the Related Art

An Oldham coupling mechanism of a scroll-type fluid displacement apparatus is known in the art. For example, U.S. Pat. No. 4,655,696, issued to Utter, describes a construction of Oldham coupling mechanism of scroll-type fluid displacement apparatus. A scroll-type fluid displacement apparatus may comprise two scroll members, each having a spiral element. The scroll members maintain an angular and radial offset, so that the spiral elements interfit to form a plurality of line contacts between the spiral curved surfaces and thereby define and seal a pair of fluid pockets. During operation, the relative orbital motion of the two scroll members shifts the line contact along the spiral curved surfaces and changes the volume of the fluid pockets. Because the volume of the fluid pockets increases or decreases dependent on the direction of the orbital motion, the scroll-type fluid displacement apparatus compresses, expands or pumps fluid. An Oldham coupling prevents relative angular movement between the orbiting scroll and the fixed scroll.

An Oldham coupling mechanism also is described in Japanese Patent Publication No. H4-224,201 to Itou. Referring to FIG. 1, scroll compressor 100 includes a housing 112, having a front housing 120 and a cup-shaped casing 121 coupled to front housing 120. Compressor 100 also includes a drive shaft 113 rotatably disposed within housing 112, a fixed scroll 114 fixed to housing 112, and an orbiting scroll 115 rotatably coupled to fixed scroll 114. Orbiting scroll 115 includes a pair of first key grooves (not shown). Drive shaft 113 connects to orbiting scroll 115, so that orbiting scroll 115 orbits around the center axis of drive shaft 113.

Oldham ring 116 includes a pair of first keys (not shown) for engaging a pair of first key grooves of orbiting scroll 115 and a pair of second keys 163 which are perpendicular to the first keys. Oldham ring 116 is disposed between housing 112 and orbiting scroll 115 to prevent self-rotation of orbiting scroll 115.

Further, front housing 120 includes a front end plate 122, which is circular in shape, and a shaft housing 123, which is funnel-shaped and is secured to front end plate 122 by bolts 119. Front end plate 122 supports the axial load of orbiting scroll 115. Front end plate 122 may be made of an iron-based material, which has superior abrasion resistance. The iron-based material may be steel, steel alloy, cast iron, or cast iron alloy. Further, the wear resistance of the materials may be taken into consideration. Moreover, front housing 120 may be casted from the above materials and finished into a desired shape by a cutting process.

Front end plate 122 may be made of the iron-based material. Consequently, the iron-based material increases the weight of the fluid apparatus. Further, it is tedious to modify ferrous-based metal (iron-based material) a desired shape because ferrous-based metals have a greater hardness in comparison with non-ferrous metals. Moreover, the time consuming forming process reduces productivity with respect to front end plate 122 and increases manufacturing cost.

SUMMARY OF THE INVENTION

A need has arisen for an Oldham coupling mechanism for a scroll-type fluid displacement apparatus which has a reduced weight and an efficient cutting process.

It is an object of the present invention to provide a scroll-type fluid displacement apparatus that may be manufactured with a increased productivity and reduced manufacturing costs. It is another object of the present invention to provide a scroll-type fluid displacement apparatus which reduces housing weight.

According to the present invention, a scroll-type fluid displacement apparatus comprises a housing having an inlet port and outlet port. The housing has a first casing and a second casing connected to the first casing. The housing is comprised of non-ferrous metal. A fixed scroll is fixedly disposed within the housing and has a first circular end plate from which a first spiral element extends into the interior of the housing. An orbiting scroll has a second circular end plate from which a second spiral element extends. The first spiral element interfit at an angular and radial offset to the second spiral element to define a plurality of line contacts with at least one pair of fluid pockets within the interior of the housing. The orbiting scroll has a pair of parallel first grooves formed on the second circular end plate. A driving mechanism is operatively connected to the orbiting scroll to effect orbital motion of the orbiting scroll. An Oldham ring is coupled to the orbiting scroll for preventing rotation of the orbiting scroll during orbital motion. The Oldham ring has a pair of first parallel key portions and a pair of second parallel key portions that are perpendicular to the pair of first parallel key portions. The first key portions engage a pair of grooves of the second circular end plate. A supporting plate member is disposed between the second casing and the orbiting scroll to support the thrust load of the orbiting scroll. The supporting plate member has a pair of grooves on a first end surface for engaging the second key portions of the Oldham ring. The supporting plate member is manufactured from ferrous metal.

Other objects, features, and advantages of this invention will be understood from the following detailed description of preferred embodiments with reference to the attached drawings.

DETAILED DESCRIPTION OF PREFERRED EMBODIMENTS

An embodiment of the present invention may be understood in more detail by referring to FIGS. 2–7, in which like numerals refer to like parts.

Figure 1:
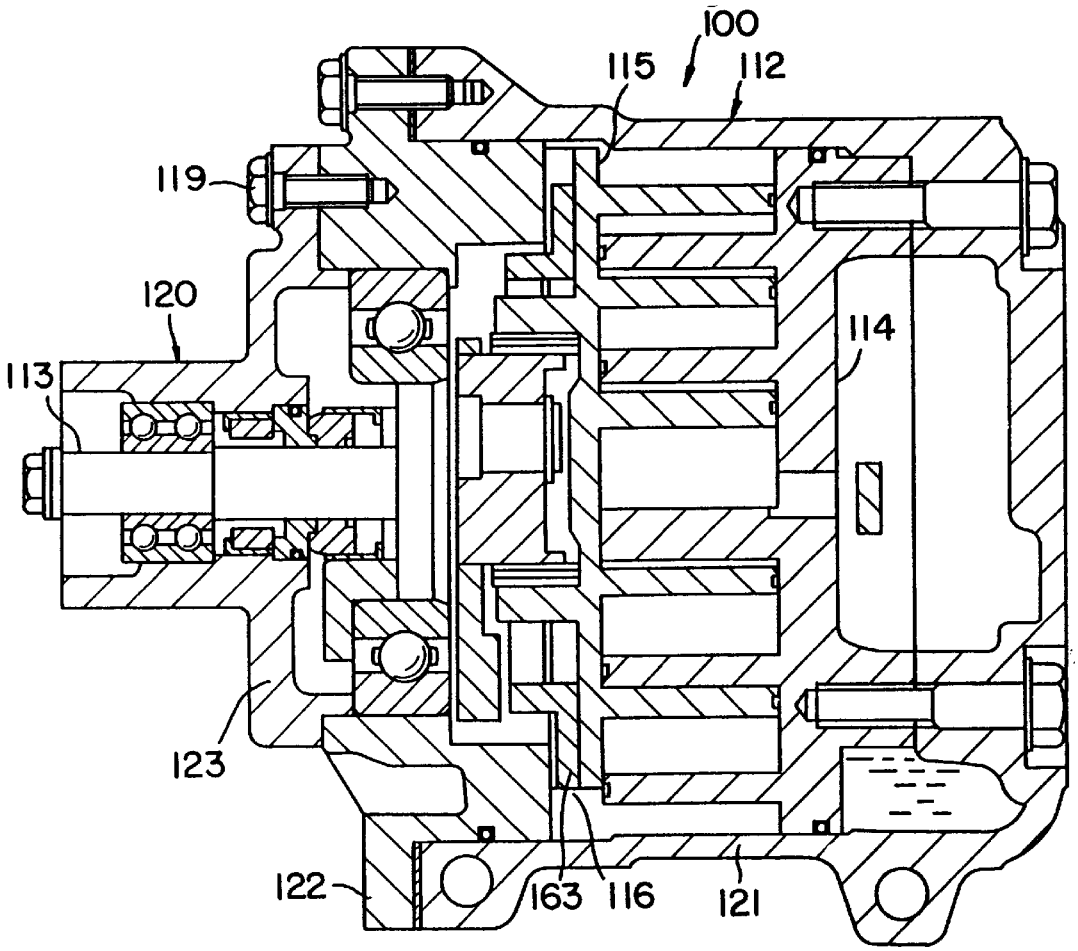
FIG. 1 (PRIOR ART)
FIG. 1 depicts a longitudinal, cross-sectional view of a known scroll compressor.
Figure 2:
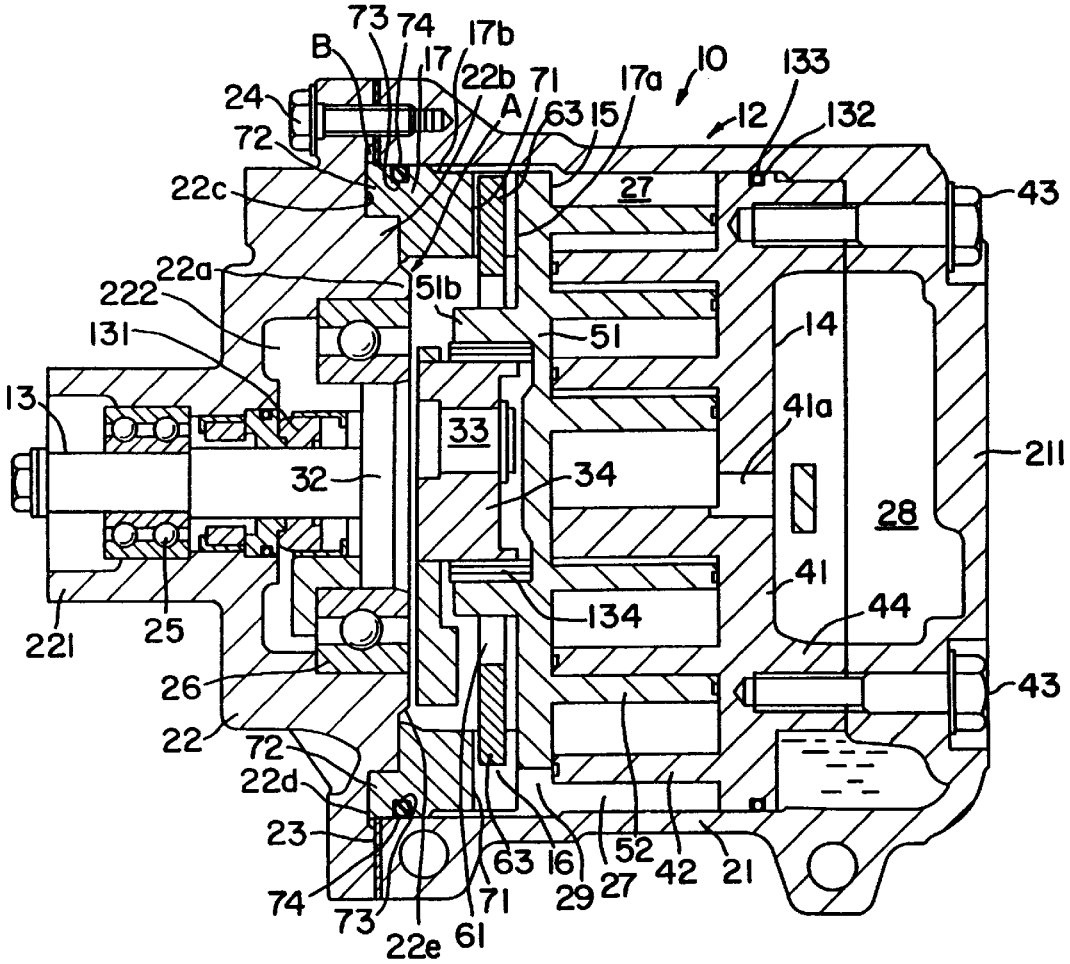
FIG. 2 depicts a longitudinal, cross-sectional view of a scroll compressor in accordance with an embodiment of a present invention.

With reference to FIG. 2, a fluid displacement apparatus, such as a scroll-type refrigerant compressor, in accordance with an embodiment of the present invention, is depicted. The left side of FIG. 2 is referred to as the forward end or front of the compressor, and the right side is referred to as the rearward end, or rear of the compressor.

Referring to FIG. 2, a scroll compressor 10 includes a compressor housing 12. Compressor housing 12 has a cup-shaped casing 21 with an open end, and front end plate 22 mounted on cup-shaped casing 21 by bolts 24, through shim 23. An annular projection 221 is formed in the rear end surface of front end plate 22. Annular projection 221 faces cup-shaped casing 21 and is concentric with opening 222. Annular projection 221 projects from the front end surface of front end plate 22 to surround drive shaft 13. Annular projection 221 defines a shaft seal cavity 131.

Front end plate 22 includes a first annular projection portion 22*a* projecting toward the inner side of cup-shaped casing 21, a second annular projection portion 22*b* axially offset from first annular projection portion 22*a*, and an annular concave portion 22*c*. Annular concave portion 22*c* is further offset from second annular projection portion 22*b* and the inner surface of front end plate 22. Annular concave portion 22*c* also radially surrounds first annular projection portion 22*a* and second annular projection portion 22*b*.

A supporting plate 17, which has an annular shape, includes annular projection portion 17*a* extending from the front side of the fluid apparatus and a pair of key grooves 71 formed on rear side of the fluid apparatus. Key grooves 71 are formed on a line passing through the center of supporting plate 17.

Supporting plate 17 is secured to front end plate 22 and disposes annular projection portion 17*a* of supporting plate 17 in annular concave portion 22*c*. A C-cut portion 22*e* is formed on the edge of annular projection portion 22*b* and creates space A between the radial inner surface of supporting plate 17 and front end plate 22. Further, C-cut portion 22*d* is formed on a first end of the edge of annular concave portion 22*c*, such that space B is created between the radial outer circumference wall of annular concave portion 22*c* and the radial outer surface of supporting plate 17.

Housing 12 may be comprised of a non-ferrous metal, which material has a reduced weight compared to steel. The non-ferrous metal may be aluminum, aluminum alloy, magnesium, or magnesium alloy. Additionally, front end plate 22 may be comprised of a non-ferrous metal.

Drive shaft 13 is rotatably supported by bearings 25 in annular projection 221. Drive shaft 13 has a disk 32 at its inner end. Disk 32 is rotatably supported by front end plate 22 through bearing 26. Cup-shaped casing 21 houses fixed scroll 14, orbiting scroll 15, and Oldham ring 16. Oldham ring 16 prevents orbiting scroll 15 from self-rotating. Fixed scroll 14 includes circular end plate 41, spiral elements 42 extending from end plate 41, and internal threaded bosses 44 axially projecting from end plate 41. The axial end surfaces of bosses 44 are sealed on the inner end surface of bottom plate portion 211 and fixed by screws 43 to bosses 44. Circular end plate 41 of fixed scroll 14 partitions the inner chamber of cup-shaped casing 21 into a front chamber 29 and a rear chamber 28. Seal ring 132 is disposed in a circumferential groove of circular end plate 41 to form a seal between the inner wall of cup-shaped casing 21 and the outer surface of circular end plate 41. Spiral elements 42 of fixed scroll 14 are positioned within front chamber 29.

Cup-shaped casing 21 has a fluid inlet port and fluid outlet port (not shown), which are connected to front chamber 29. A discharge port 41*a* is formed through circular end plate 41 at a position near the center of spiral element 42. A reed valve (not shown) closes discharge port 41*a*.

Located in front chamber 29, orbiting scroll 15 includes circular end plate 51, annular boss 51*b* extending from circular end plate 51, and spiral elements 52 extending from circular end plate 51. Orbiting scroll 15 includes a pair of grooves 51*a* formed in a first end of circular end plate 51. A pair of grooves 51*a* extend from the radial outer circumference of annular boss 51*b* to the outer radial edge of circular end plate 51.

Spiral elements 42 and 52 interfit at an angular offset of about 180 degrees, and at a predetermined radial offset. Further, spiral elements 42 and 52 define a pair of sealed, fluid pockets 27 between their surfaces. Orbiting scroll 15 is supported by bushing 34 through bearing 134 located between bushing 34 and annular boss 51*b*. Bushing 34 is connected to the inner end of disk 32 through pin 33 at a radially offset location from the axis of drive shaft 13. Drive shaft 13 may be driven by an external power source, such as an engine of an automobile, through a magnetic clutch (not shown).

Figure 3:
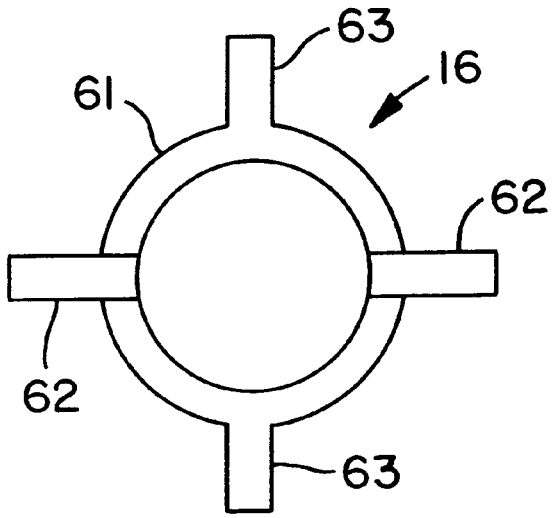
FIG. 3 is a plane view of an Oldham ring of a scroll compressor in accordance with the present invention.
Figure 4:
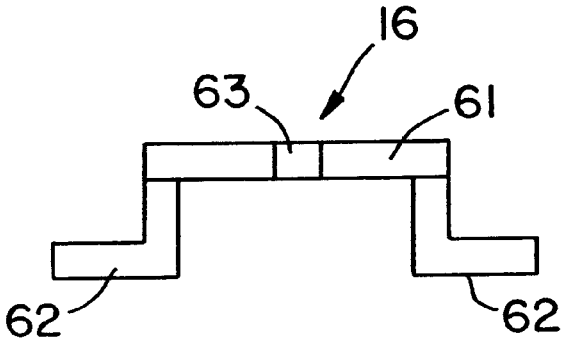
FIG. 4 is a side view of an Oldham ring of a scroll compressor in accordance with the present invention.

Referring to FIGS. 3 and 4, Oldham ring 16 includes ring portion 61, first key portions 62, which are formed on a flat surface distinct from a first end surface of ring portion 61, and second key portions 63, which are formed on the same surface as ring portion 61. First key portions 62 extend radially from the peripheral surface of ring portion 61 and are opposite to each other. Second key portions 63 extend radially from the peripheral surface of ring portion 61 and are opposite to each other. First key portions 62 are located, such that they are perpendicular to second key portions 63.

Figure 5:
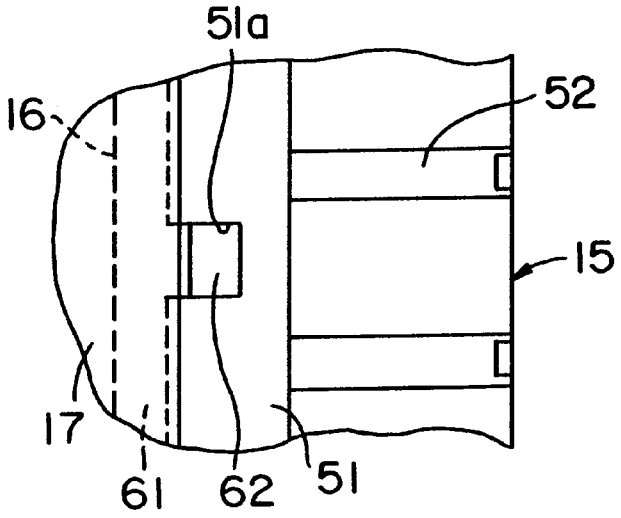
FIG. 5 is a cross-sectional view of an Oldham ring coupled to an orbiting scroll of a scroll compressor in accordance with the present invention.
Figure 6:
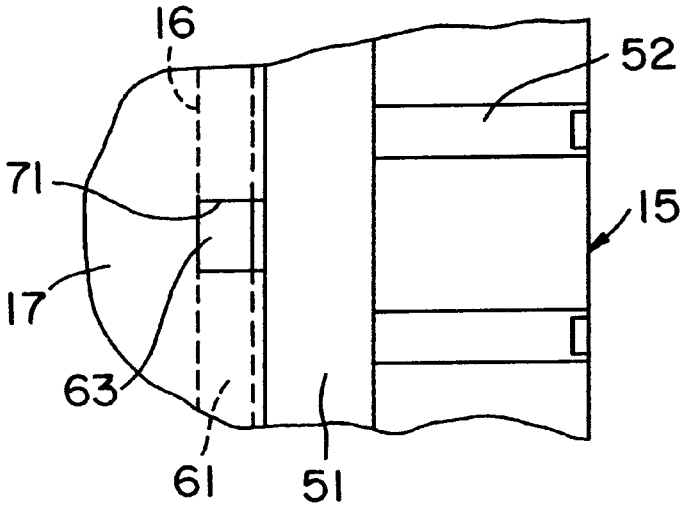
FIG. 6 is a second, cross-sectional view of an Oldham ring coupled to an orbiting scroll of a scroll compressor in accordance with the present invention.

Referring to FIGS. 5 and 6, Oldham ring 16 is disposed between supporting plate 17 and orbiting scroll 15 to prevent self-rotation of orbiting scroll 15 as it orbits. First key portions 62 of Oldham ring 16 are slidably inserted into key grooves 51*a* of orbiting scroll 15. Second key portions 63 of Oldham ring 16 are slidably inserted into key grooves 71 of supporting plate 17.

Referring again to FIG. 2, supporting plate 17 may be comprised of a ferrous-based metal (iron-based material), such as steel, steel alloy, cast iron, or cast iron alloy. Supporting plate 17 supports the axial load of orbiting scroll 15 as it orbits. Supporting plate 17 includes an annular groove 73 formed on the radial outer surface of supporting plate 17 for accommodating a seal element 74. Seal element 74 seals the inner surface of cup-shape casing 21 and the radial outer surface of supporting plate 17.

As orbiting scroll 15 orbits, the line contacts between spiral elements 42 and 52. This contract, causes fluid pockets 27, which are formed between spiral elements to move toward the center with a consequent reduction in volume and a compression a working fluid (e.g., refrigerant gas).

In addition, refrigerant gas may be introduced from a component, such as an evaporator (not shown), of a refrigerant circuit (not shown), through a fluid inlet and also may be taken into fluid pockets 27. The refrigerant gas taken into fluid pockets 27 is compressed and discharged through discharge port 41*a* into rear chamber 28 from the central fluid pockets of spiral elements 42 and 52. Thereafter, the refrigerant gas may flow through an outlet to another component, such as a condenser (not shown).

In a method for manufacturing such apparatus, supporting plate 17 is secured to front end plate 22 by a monobloc casting method. First, supporting plate 17 is formed by casting or forging. Second, supporting plate 17 is molded to form front end plate 22 either by casting or forging, without finishing the treatment of the surface of supporting plate 17. Third, supporting plate 17 is secured to front end plate 22, such that front end plate 22 is formed by using the above mold. Fourth, peripheral surface 17*a*, which faces orbiting scroll 15, is cut in plate 17. This results in a radial outer surface 17*b* and radial inner surface 17*c* of supporting plate 17 which are finished by a machining of the metals.

In the cutting process, a first cutting tool may be used for the ferrous-based metal. A second cutting tool may be used for the non-ferrous metal, which has a reduced hardness compared to the ferrous-based metal. Thus, cutting non-ferrous metal separately reduces the time of the cutting process and prolongs the life of the cutting tools.

Thus, in this arrangement of the embodiment of the method, front end plate 22 and supporting plate 17 may be finished with two kinds of cutting tools because space A and space B allow changing a first tool for a second tool. Further, the method may not require a finishing process. Therefore, it may not be necessary to finish space A and space B.

Consequently, the compressor of the embodiment may have a reduced weight in comparison with the prior art because supporting plate 17, which is be made of high-abrasion resistant material, such as ferrous-based metal steel or steel alloy, supports the thrust load of orbiting scroll 15 and front end plate 22, which is made of non-ferrous metal, such that is lighter than ferrous-based metal. Further, the choice of materials for the fabrication of front end plate 22 may facilitate the cutting process because it is comprised of non-ferrous metal, which has a reduced hardness as compared to ferrous metal. As a result, production cost of the compressor may be reduced in comparison with that of the known scroll-type compressors.

Figure 7:
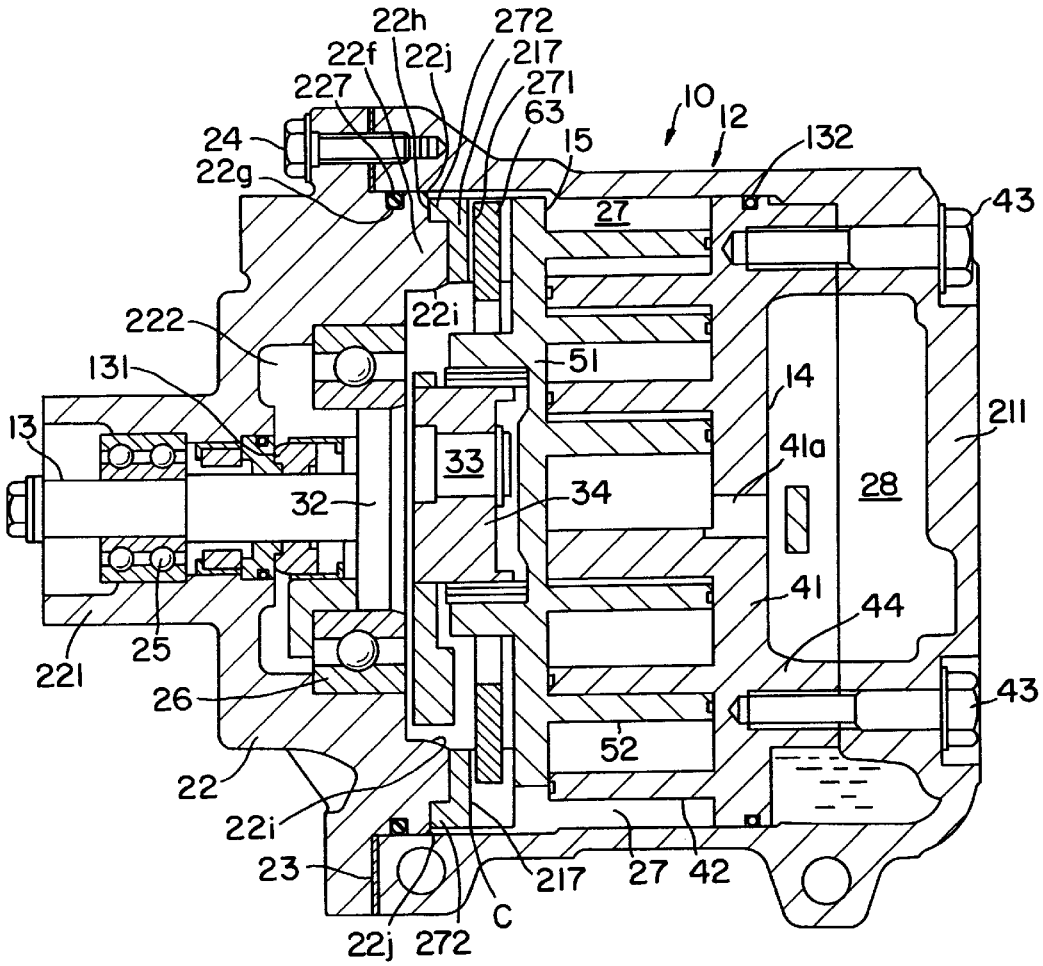
FIG. 7 depicts a longitudinal, cross-sectional view of a scroll compressor in accordance with another embodiment of the present invention

FIG. 7 illustrates another embodiment of the present invention. Elements in FIG. 7 that are similar to those in FIG. 2 are designated with like reference numerals. A detailed explanation of the elements and their characteristics is provided above and, therefore, is omitted from this embodiment.

Front end plate 22 includes an annular projection portion 22*f*, extending from the axial inner end surface of front end plate 22, an annular groove 22*g* formed on the outer peripheral surface of annular projection portion 22*f*, and a notched portion 22*h* formed in the radial outer side of projection portion 22*f*. A sealing member 227, such as an O-ring, is inserted into annular groove 22*g* for creating a seal between the inner surface of cup-shaped casing 21 and the outer radial surface of annular projection portion 22*f*.

A supporting palate 217, which may be an annular ring, includes an annular projection portion 272 extending from a first end of supporting plate 217, and key grooves 271 formed on the rear side of supporting plate 217. Supporting plate 217 is disposed in front end plate 22, such that annular projection portion 272 engages notched portion 22*h*. Space C is created between the inner surface of cup-shaped casing 21 and the radial outer surface of supporting plate 217.

Front end plate 22 includes tapered portion 22*i* formed on the radial outer corner of annular projection portion 22*h* and tapered portion 22*j* formed on the radial inner corner of annular projection portion 22*h*. Tapered portions 22*i* and 22*j* may be finished without flash, i.e., without a fin of excess metal along the joint line between the tapered portions.

In the manufacture of this configuration, a cutting tool may be changed from a first cutting tool to a second tool at tapered portions 22*i* and 22*j*.

Although the present invention has been described in connection with the preferred embodiments, the invention is not limited thereto. It may be understood by those of ordinary skill in the art that variations and modifications may be made within the scope of this invention as defined by the claims.

What is claimed is:

1. A scroll-type fluid displacement apparatus comprising:

a housing having an inlet port and outlet port, said housing having a first casing and a second casing connected to said first casing, said housing made from a non-ferrous metal;

a fixed scroll fixedly disposed within said housing and having a first circular end plate from which a first spiral element extends into said housing;

an orbiting scroll having a second circular end plate from which a second spiral element extends, wherein said first spiral element interfits said second spiral element at an angular and radial offset to form a plurality of line contacts to define at least one pair of fluid pockets within said housing, said orbiting scroll having a pair of parallel first grooves formed on said second circular end plate;

a driving mechanism connected to said orbiting scroll to effect orbital motion of said orbiting scroll;

an Oldham ring coupled to said orbiting scroll for preventing rotation of said orbiting scroll during orbital motion, said Oldham ring having a pair of first parallel key portions and a pair of second parallel key portions perpendicular to said pair of first parallel key portions, said first key portions engaging said pair of grooves of said second circular end plate; and a supporting member disposed between said second casing and said orbiting scroll that supports a thrust load of said orbiting scroll, said supporting member having grooves formed on a first end surface for engaging said second key portions of said Oldham ring, wherein said supporting member is made from a ferrous metal;

wherein said supporting member is connected to an inner side surface of said second casing.

2. A scroll-type fluid displacement apparatus comprising:

a housing having an inlet port and outlet port, said housing having a first casing and a second casing connected to said first casing, said housing made from a non-ferrous metal;

a fixed scroll fixedly disposed within said housing and having a first circular end plate from which a first spiral element extends into said housing;

an orbiting scroll having a second circular end plate from which a second spiral clement extends, wherein said first spiral element interfits said second spiral element at an angular and radial offset to form a plurality of line contacts to define at least one pair of fluid pockets within said housing, said orbiting scroll having a pair of parallel first grooves formed on said second circular end plate;

a driving mechanism connected to said orbiting scroll to effect orbital motion of said orbiting scroll;

an Oldham ring coupled to said orbiting scroll for preventing rotation of said orbiting scroll during orbital motion, said Oldham ring having a pair of first parallel key portions and a pair of second parallel key portions perpendicular to said pair of first parallel key portions, said first key portions engaging said pair of grooves of said second circular end plate; and a supporting member disposed between said second casing and said orbiting scroll that supports a thrust load of said orbiting scroll, said supporting member having grooves formed on a first end surface for engaging said second key portions of said Oldham ring, wherein said supporting member is made from a ferrous metal;

wherein spaces are radially created between said supporting member and said first and second casings.

3. The scroll-type fluid displacement apparatus of claim 1, wherein said spaces are created between a radial outer surface of said supporting member and an inner surface of said housing.

4. A scroll-type fluid displacement apparatus comprising:

a housing having an inlet port and outlet port, said housing having a first casing and a second casing connected to said first casing, said housing made from a non-ferrous metal;

a fixed scroll fixedly disposed within said housing and having a first circular end plate from which a first spiral element extends into said housing;

an orbiting scroll having a second circular end plate from which a second spiral element extends, wherein said first spiral element interfits said second spiral element at an angular and radial offset to form a plurality of line contacts to define at least one pair of fluid pockets within said housing, said orbiting scroll having a pair of parallel first grooves formed on said second circular end plate;

a driving mechanism connected to said orbiting scroll to effect orbital motion of said orbiting scroll;

an Oldham ring coupled to said orbiting scroll for preventing rotation of said orbiting scroll during orbital motion, said Oldham ring having a pair of first parallel key portions and a pair of second parallel key portions perpendicular to said pair of first parallel key portions, said first key portions engaging said pair of grooves of said second circular end plate; and a supporting member disposed between said second casing and said orbiting scroll that supports a thrust load of said orbiting scroll, said supporting member having grooves formed on a first end surface for engaging said second key portions of said Oldham ring, wherein said supporting member is made from a ferrous metal;

wherein said second casing includes an annular projection portion extending from an inner end surface, said annular projection portion engaging said supporting member.

5. The scroll-type fluid displacement apparatus of claim 1, wherein annular, tapered portions are formed at corners of said annular projection portion.

6. A scroll-type fluid displacement apparatus comprising:

a housing having an inlet port and outlet port, said housing having a first casing and a second casing connected to said first casing, said housing made from a non-ferrous metal;

a fixed scroll fixedly disposed within said housing and having a first circular end plate from which a first spiral element extends into said housing;

an orbiting scroll having a second circular end plate from which a second spiral element extends, wherein said first spiral element interfits said second spiral element at an angular and radial offset to form a plurality of line contacts to define at least one pair of fluid pockets within said housing, said orbiting scroll having a pair of parallel first grooves formed on said second circular end plate;

a driving mechanism connected to said orbiting scroll to effect orbital motion of said orbiting scroll;

an Oldham ring coupled to said orbiting scroll for preventing rotation of said orbiting scroll during orbital motion, said Oldham ring having a pair of first parallel key portions and a pair of second parallel key portions perpendicular to said pair of first parallel key portions, said first key portions engaging said pair of grooves of said second circular end plate; and a supporting member disposed between said second casing and said orbiting scroll that supports a thrust load of said orbiting scroll, said supporting member having grooves formed on a first end surface for engaging said second key portions of said Oldham ring, wherein said supporting member is made from a ferrous metal;

wherein said supporting member is connected to an inner side surface of said second casing by a monoblock casting.

* * * * *